US007181785B2

(12) United States Patent
Dinan et al.

(10) Patent No.: US 7,181,785 B2
(45) Date of Patent: Feb. 27, 2007

(54) SLEEPING BAG WITH INSULATED FOOT POCKET

(75) Inventors: Ryan E. Dinan, New Haven, MO (US); Robert Cantwell, Leslie, MO (US)

(73) Assignee: North Pole Limited, Kowloon (HK)

( * ) Notice: Subject to any disclaimer, the term of this patent is extended or adjusted under 35 U.S.C. 154(b) by 123 days.

(21) Appl. No.: 11/021,832

(22) Filed: Dec. 24, 2004

(65) Prior Publication Data

US 2006/0137093 A1 Jun. 29, 2006

(51) Int. Cl.
*A47G 9/08* (2006.01)

(52) U.S. Cl. ..... 5/413 R

(58) Field of Classification Search ..... 5/413 R, 5/413 A, 485, 482, 502; 2/69, 69.5
See application file for complete search history.

(56) References Cited

U.S. PATENT DOCUMENTS 3,750,202 A * 8/1973 Merikallio ..... 5/413 R
4,183,111 A * 1/1980 Zahavkochav ..... 5/413 R
5,005,235 A * 4/1991 Huang ..... 5/413 R
5,657,497 A * 8/1997 Howe ..... 5/413 R
6,199,232 B1 * 3/2001 Kocivar ..... 5/502
6,338,173 B1 * 1/2002 Ramsey ..... 5/413 R
6,671,903 B2 * 1/2004 Bowers et al. ..... 5/413 R
2002/0170112 A1 * 11/2002 Bowers et al. ..... 4/413 R
2006/0090242 A1 * 5/2006 Zuckerwar ..... 2/159

FOREIGN PATENT DOCUMENTS

AU B34343/95 * 7/1996
DE 29714061 U1 * 11/1997
EP 0761145 A2 * 12/1997

* cited by examiner

*Primary Examiner*—Alexander Grosz
(74) *Attorney, Agent, or Firm*—Armstrong Teasdale LLP

(57) ABSTRACT

A sleeping bag includes a sleeping bag body configured to envelope a person lying within the sleeping bag body, and a section of thermal fleece material attached to the inside surface of the sleeping bag body at a designated area, configured to provide additional warmth to a sleeping bag user at the designated area. In one aspect of the invention, the designated area includes a foot area. In another aspect of the invention, the thermal fleece material is soft to touch. In another aspect of the invention, the sleeping bag body is configured to couple to another sleeping bag body to form a larger sleeping bag. Advantages of the invention include the ability to provide added thermal insulation to a sleeping bag, as well as added comfort to a sleeping bag user, at a designated area of the sleeping bag.

17 Claims, 3 Drawing Sheets

SLEEPING BAG WITH INSULATED FOOT POCKET

FIELD

The present invention relates generally to sleeping bags, and more particularly to insulated sleeping bags.

BACKGROUND

A warm sleeping bag is essential to any camping or backpacking trip, especially in cold weather. To this end, many sleeping bags have been produced with lightweight and warm insulation. One problem with such sleeping bags is that, although they are generally warm, because they have fixed weights of insulation distributed evenly throughout them, there can be areas of a person's body, 'cool spots', that remain cool or cold while other body parts are warm. For example, the area surrounding the feet may be such a cool spot.

Therefore, a sleeping bag that provides additional thermal insulation at a designated area is needed.

SUMMARY

The invention overcomes the identified limitations and provides a sleeping bag with added thermal insulation at a designated area.

An exemplary embodiment of a sleeping bag includes a sleeping bag body configured to envelope a person lying within the sleeping bag body, and a section of thermal fleece material attached to the inside surface of the sleeping bag body at a designated area, configured to provide additional warmth to a sleeping bag user at the designated area.

In one aspect of the invention, the designated area includes a foot area. In another aspect of the invention, the thermal fleece material is soft to touch. In another aspect of the invention, the sleeping bag includes a pillow coupled to the sleeping bag body configured to provide cushioning to the sleeping bag user's head. In another aspect of the invention, the sleeping bag includes a draft tube attached around a portion of the perimeter of the sleeping bag body, configured to prevent unwanted airflow into the sleeping bag. In another aspect of the invention, the sleeping bag includes a dry loop coupled to the sleeping bag body configured to hang the sleeping bag for drying. In another aspect of the invention, the sleeping bag body is configured to couple to another sleeping bag body to form a larger sleeping bag. In another aspect of the invention, the larger sleeping bag is configured to sleep two people. In another aspect of the invention, the sleeping bag includes a zipper configured to couple the sleeping bag body to the other sleeping bag body.

In another embodiment, a compound sleeping bag includes a first sleeping bag and a second sleeping bag. The first sleeping bag includes a first sleeping bag body configured to provide a bottom to the compound sleeping bag, and a first section of thermal fleece material attached to the inside surface of the first sleeping bag body at a first designated area, configured to provide additional warmth to a sleeping bag user at the first designated area. The second sleeping bag includes a second sleeping bag body configured to provide a top to the compound sleeping bag, and a second section of thermal fleece material attached to the inside surface of the second sleeping bag body at a second designated area, configured to provide additional warmth to a sleeping bag user at the second designated area. The first sleeping bag is configured to couple to the second sleeping bag to form the compound sleeping bag. In one aspect, the compound sleeping bag includes a draft tube attached around a portion of the perimeter of at least one of the sleeping bag bodies, configured to prevent unwanted airflow into the compound sleeping bag.

Advantages of the invention include the ability to provide added thermal insulation to a sleeping bag, as well as added comfort to a sleeping bag user, at a designated area of the sleeping bag.

DRAWINGS

The invention will be described with reference to the drawings, in which.

DETAILED DESCRIPTION

Exemplary embodiments are described herein to provide a detailed description of the invention. Variations of these embodiments will be apparent to those of skill in the art. For example, the invention is described with reference to thermal fleece material in a foot area, but the invention may also apply to thermal fleece material used in other areas of the sleeping bag, such as a chest area or mid-section area.

Figure 1A:
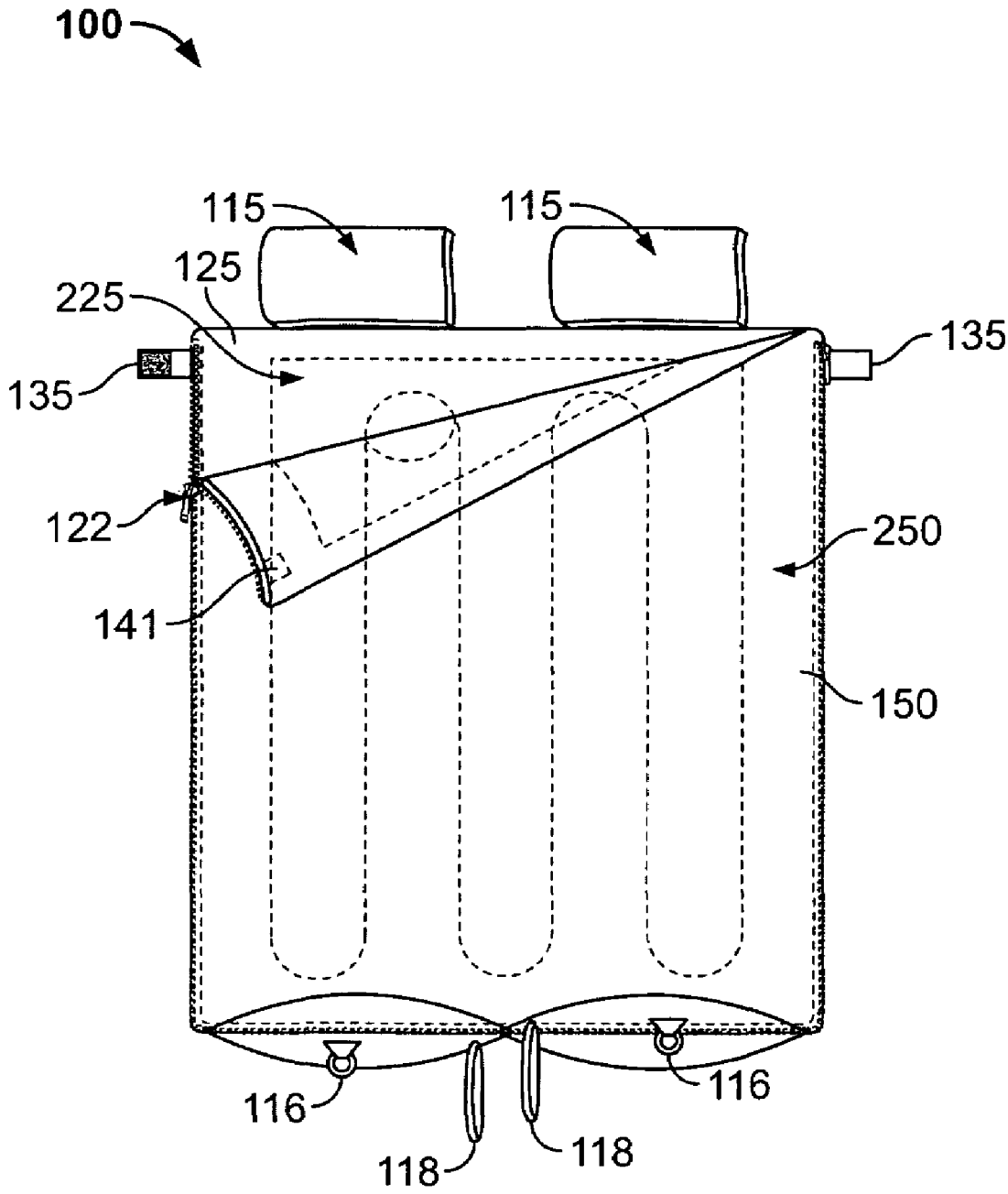
FIG. 1A is a top view showing a compound sleeping bag formed by coupling two sleeping bags, according to an embodiment of the invention.

FIG. 1A is a top view showing a compound sleeping bag 100 formed by coupling two sleeping bags 225 and 250, according to an embodiment of the invention. In the embodiment, the compound sleeping bag 100 includes a first sleeping bag 225 and a second sleeping bag 250. The first sleeping bag 225 includes a first sleeping bag body 125 configured to provide a bottom to the compound sleeping bag 100, and a first section of thermal fleece material 160 attached to the inside surface of the first sleeping bag body 125 at a first designated area, configured to provide additional warmth to a sleeping bag user at the first designated area. The second sleeping bag 250 includes a second sleeping bag body 150 configured to provide a top to the compound sleeping bag 100, and a second section of thermal fleece material 160 attached to the inside surface of the second sleeping bag body 150 at a second designated area, configured to provide additional warmth to a sleeping bag user at the second designated area. The first sleeping bag 225 is configured to couple to the second sleeping bag 250 to form the compound sleeping bag 100.

In the embodiment described with reference to FIG. 1A, the compound sleeping bag 100 also includes an optional set of pillows 115 coupled to the first sleeping bag body 125, configured to provide cushioning to the sleeping bag user's head. The sleeping bag may include zero, one, or two pillows 115. In the embodiment, the compound sleeping bag 100 also includes a zipper 122 configured to couple the first sleeping bag body to the second sleeping bag body. The compound sleeping bag 100 may also include a zipper stop comprising rough VELCRO™ portions 135 and soft VELCRO™ portions 141. In one aspect, the compound sleeping bag 100 is configured to sleep two people (a "queen" bag).

Figure 1B:
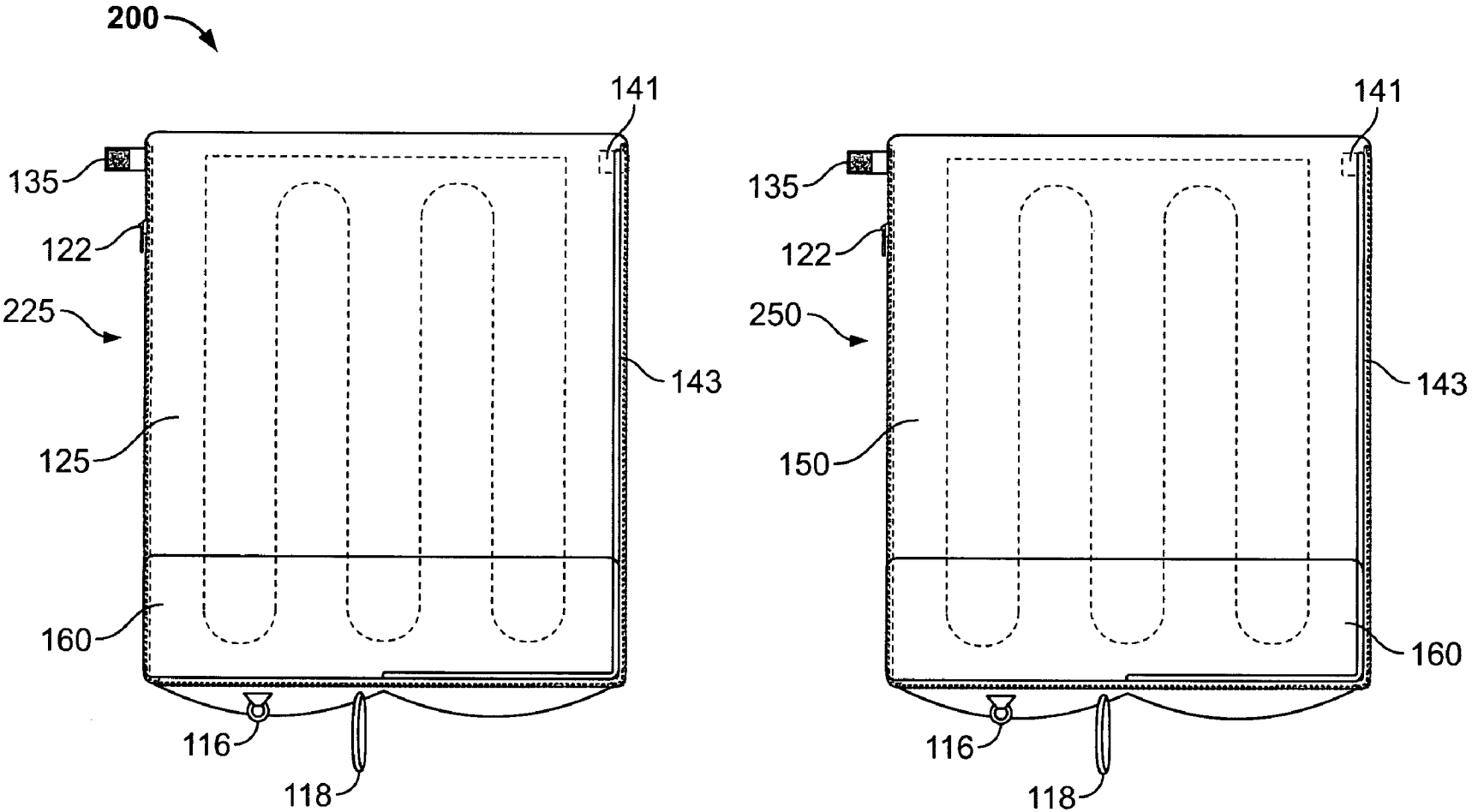
FIG. 1B is a top view showing the two sleeping bags, separated from one another in an open configuration, having sections of thermal fleece material at the foot areas, according to an embodiment of the invention.

FIG. 1B is a top view showing the two sleeping bags 225 and 250, separated from one another in an open configuration, having the sections of thermal fleece material 160 at the foot areas, according to an embodiment of the invention. In the embodiment, each sleeping bag 225 and 250 includes the sleeping bag body 125 and 150, respectively, configured to envelope a person lying within the sleeping bag body, and a section of thermal fleece material 160 attached to the inside surface of the sleeping bag body at a designated area, configured to provide additional warmth to a sleeping bag user at the designated area.

In the embodiment, the designated area comprises a foot area. However, the section of thermal fleece material 160 may also be attached to other areas of the sleeping bag, such as a chest area or mid-section area. In one aspect, the thermal fleece material is soft to touch, making it more comfortable for the sleeping bag user's feet or other exposed body parts.

In one aspect, the sleeping bag also includes a draft tube 143 attached around a portion of the perimeter of the sleeping bag body, configured to prevent unwanted airflow into the sleeping bag. In another aspect, the sleeping bag also includes a dry loop 116, coupled to the sleeping bag, configured to hang the sleeping bag for drying. In yet another aspect, the sleeping bag includes a band 118, made of elastic or other material, coupled to the sleeping bag configured to secure the sleeping bag in a rolled configuration.

Figure 1C:
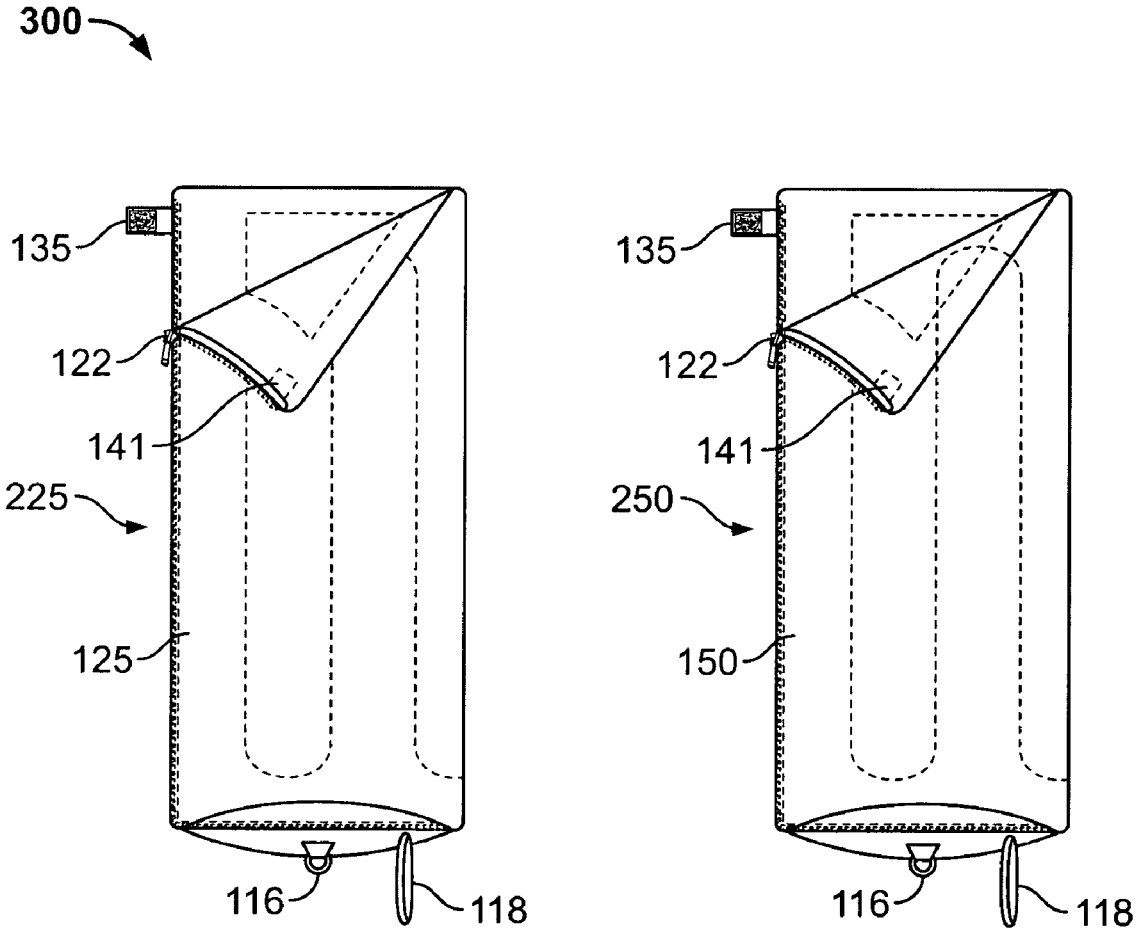
FIG. 1C is a top view showing the two sleeping bags, separated from one another in a closed configuration, according to an embodiment of the invention.

FIG. 1C is a top view showing the two sleeping bags 225 and 250, separated from one another in a closed configuration, according to an embodiment of the invention. That is, FIG. 1C shows the sleeping bags in a 'zipped-up' configuration, as would typically be done for an individual sleeping bag user.

It shall be understood by those of ordinary skill in the art that the techniques described herein may apply to individual sleeping bags (such as the first sleeping bag 225 and the second sleeping bag 250), or to compound sleeping bags (such as the compound sleeping bag 100), which include two or more individual sleeping bags. The generic term 'sleeping bag' is used herein to refer to individual sleeping bags and compound sleeping bags.

Advantages of the invention include the ability to provide added thermal insulation to a sleeping bag, as well as added comfort to a sleeping bag user, at a designated area of the sleeping bag.

Having disclosed exemplary embodiments and the best mode, modifications and variations may be made to the disclosed embodiments while remaining within the subject and spirit of the invention as defined by the following claims.

The invention claimed is:

1. A sleeping bag comprising:

a sleeping bag body configured to envelop a person lying within the sleeping bag body, the sleeping bag body defining a foot area; and a section of thermal fleece material attached to an inside surface of the sleeping bag body at the foot area and adapted to contact a user's feet, the section of thermal fleece configured to provide additional warmth to a sleeping bag user at the foot area, whereby the foot area has more insulation than other portions of the sleeping bag body.

2. The sleeping bag of claim 1, wherein the thermal fleece material is soft to touch.

3. The sleeping bag of claim 1, further comprising a pillow coupled to the sleeping bag body configured to provide cushioning to the sleeping bag user's head.

4. The sleeping bag of claim 1, further comprising a draft tube attached around a portion of the perimeter of the sleeping bag body, configured to prevent unwanted airflow into the sleeping bag.

5. The sleeping bag of claim 1, further comprising a dry loop coupled to the sleeping bag body configured to hang the sleeping bag for drying.

6. The sleeping bag of claim 1, wherein the sleeping bag body is configured to couple to another sleeping bag body to form a larger sleeping bag.

7. The sleeping bag of claim 6, wherein the larger sleeping bag is configured to sleep two people.

8. The sleeping bag of claim 6, wherein the thermal fleece material is soft to touch.

9. The sleeping bag of claim 6, further comprising a zipper configured to couple the sleeping bag body to the another sleeping bag body.

10. The sleeping bag of claim 1, further comprising:

a zipper coupled to at least a portion of a perimeter of the sleeping bag body, the zipper configured to facilitate closing the sleeping bag; and a draft tube positioned with respect to at least a portion of the zipper, the draft tube configured to prevent airflow through the zipper.

11. A compound sleeping bag comprising:

a first sleeping bag comprising:

a first sleeping bag body configured to provide a bottom to the compound sleeping bag, the first sleeping bag body defining a first foot area;

a first section of thermal fleece material attached to an inside surface of the first sleeping bag body at the first foot area, the first section of thermal fleece configured to provide additional warmth to a sleeping bag user at the first foot area and adapted to contact a user's feet, whereby the first foot area has more insulation than other portions of the first section; and a second sleeping bag comprising:

a second sleeping bag body configured to provide a top to the compound sleeping bag, the second sleeping bag body defining a second foot area; and a second section of thermal fleece material attached to an inside surface of the second sleeping bag body at the second foot area and adapted to contact a user's feet, the second section of thermal fleece configured to provide additional warmth to a sleeping bag user at the second foot area, whereby the second foot area has more insulation than other portions of the second, the first sleeping bag coupled to the second sleeping bag to form the compound sleeping bag.

12. The sleeping bag of claim 11, wherein the thermal fleece material is soft to touch.

13. The sleeping bag of claim 11, further comprising a pillow coupled to the first sleeping bag body, configured to provide cushioning to the sleeping bag user's head.

14. The sleeping bag of claim 11, further comprising a draft tube attached around a portion of the perimeter of at least one of the sleeping bag bodies, configured to prevent unwanted airflow into the compound sleeping bag.

15. The sleeping bag of claim 11, further comprising a dry loop coupled to at least one of the sleeping bag bodies, configured to hang the compound sleeping bag for drying.

16. The sleeping bag of claim 11, further comprising at least one zipper configured to couple the first sleeping bag to the second sleeping bag.

17. The sleeping bag of claim 16, further comprising:

at least one draft tube positioned with respect to the at least one zipper, the at least one draft tube configured to limit airflow through the at least one zipper.

* * * * *